US006290458B1

(12) United States Patent
Irie et al.

(10) Patent No.: US 6,290,458 B1
(45) Date of Patent: Sep. 18, 2001

(54) TURBO MACHINES

(75) Inventors: Kouichi Irie, Tsuchiura; Tomoyoshi Okamura, Higashiibaraki-gun; Akira Manabe, Niihari-gun; Junichi Kurokawa, 4-10-3 Mori, Isogo-ku, Yokohama, Kanagawa-ken, all of (JP)

(73) Assignees: Hitachi, Ltd., Tokyo; Junichi Kurokawa, Yokohama, both of (JP)

( * ) Notice: Subject to any disclaimer, the term of this patent is extended or adjusted under 35 U.S.C. 154(b) by 0 days.

(21) Appl. No.: 09/531,464

(22) Filed: Mar. 20, 2000

Related U.S. Application Data

(63) Continuation-in-part of application No. 09/399,132, filed on Sep. 20, 1999.

(51) Int. Cl.[7] ..... F01D 25/04

(52) U.S. Cl. ..... 415/119; 415/173.1; 415/914

(58) Field of Search ..... 415/119, 173.1, 415/173.5, 914, 208.3, 208.5, 211.1

(56) References Cited

U.S. PATENT DOCUMENTS

| | | | | |
|---|---|---|---|---|
| 3,994,620 | * | 11/1976 | Spraker, Jr. et al. | 415/145 |
| 4,086,022 | | 4/1978 | Freeman . | |
| 4,239,452 | * | 12/1980 | Roberts, Jr. | 415/172 A |
| 4,257,733 | * | 3/1981 | Bandukwalla et al. | 415/13 |
| 4,466,772 | | 8/1984 | Okapuu . | |
| 5,277,541 | | 1/1994 | Palmer . | |
| 5,308,225 | * | 5/1994 | Koff et al. | 415/57.3 |
| 5,431,533 | * | 7/1995 | Hobbs | 415/58.7 |
| 5,474,417 | * | 12/1995 | Privett et al. | 415/58.5 |
| 5,607,284 | * | 3/1997 | Byrne et al. | 415/58.5 |
| 5,762,470 | | 6/1998 | Gelmedov . | |
| 6,158,956 | * | 12/2000 | Arnold | 415/158 |

FOREIGN PATENT DOCUMENTS

| | | |
|---|---|---|
| 229519 | 7/1987 | (EP) . |
| 2202585 | 9/1988 | (GB) . |
| 2285485 | 7/1995 | (GB) . |
| 9510692 | 4/1995 | (WO) . |

* cited by examiner

*Primary Examiner*—Edward K. Look
*Assistant Examiner*—James M McAleenan
(74) *Attorney, Agent, or Firm*—Antonelli, Terry, Stout & Kraus, LLP

(57) ABSTRACT

For improving characteristic uprising at the right-hand side of head-flow rate characteristic of a turbo machine, as well as for suppressing increase of vibration and/or noises thereof, a plurality of first grooves 24 in direction of gradient in pressure of fluid are formed on an inner flow surface of a casing, for connecting an inlet side of blades of an impeller and an area on the inner flow surface of the casing where the impeller blades reside in, over an inner circumference of the casing. Also, second grooves 25 in a circumferential direction are formed in an area on the inner flow surface of the casing where the impeller blades reside in, for communicating the first grooves in the circumferential direction of the casing.

17 Claims, 11 Drawing Sheets

TURBO MACHINES

This application is a continuation-in part of application Ser. No. 09/399,132 filed Sep. 20, 1999, now pending.

BACKGROUND OF THE INVENTION

1. Field of the Invention

The present invention relates to turbo machines, and in particular relates to a turbo machine being able to prevent from instability in flow, by suppressing swirl due to recirculation flow at an inlet of an impeller and by suppressing rotation stalls of the impeller, irrespective of the types and the fluid thereof.

In more details, the present invention relates to the turbo machines, such as for a pump, a compressor, a blower, etc., having non-volume type impeller therein, and in particular, relates to the turbo machine being able to prevent from the instability in flow, by suppressing a swirl or pre-whirl which is generated due to a main flow or component of the recirculation occurring at an inlet of an impeller and by suppressing rotation stalls thereof, thereby being suitable to be applied into a mixed-flow pump, which is used widely as water circulating pumps in a thermal power plant or in a nuclear power plant, or as drainage pumps, etc.

2. Description of Prior Art

Rotary machines being called by a name of "turbo machine" can be classified as below, depending upon the fluids by which the machines are operated and in types thereof.

1. With fluids by which the machine is operated:

Liquid, and Gas.

2. In Types:

An axial flow type, a mixed-f low type, and a centrifugal type.

Now, a mixed-flow pump is used mainly or widely due to easiness in operation thereof, and it comprises a suction casing, a pump and a diffuser, in a sequence from upper stream to down stream thereof.

A blade (of an impeller) rotating within a casing of the pump is rotationally driven on a rotary shaft, thereby supplying energy to the liquid which is suctioned from the suction casing. The diffuser has a function of converting a portion of velocity (or kinetic) energy of the liquid into static pressure.

A typical characteristic curve between a head and a flow rate of the turbo machine including the mixed-flow pump, where the horizontal axis shows a parameter indicating the flow rate while the vertical axis a parameter indicating the head, is as follows. Namely, it is common that the head falls down in the reverse relation to an increase of the flow rate in a region of low flow rate, however it has a characteristic of uprising at the right-hand side following the increase of the flow rate, during the time when the flow rate lies within a certain specific region. However, when the flow rate rises up further exceeding over the right-hand uprising region of the characteristic curve, the head begins to fall down, again, following the increase in the flow rate.

In a case where the turbo machine is operated with the flow rate of such the characteristic curve of uprising at the right-hand side, a mass of the liquid vibrates by itself, i.e., generating a surging phenomenon. It is believed that such the characteristic curve of uprising at the right-hand side is caused by, though the recirculation comes out at an outer edge of the inlet of the impeller when the flow rate flowing through the turbo machine is low, since at that instance, a flow passage or a channel for the liquid flowing into the impeller is narrowed and thereby generating a swirl in the liquid flowing into the impeller due to the influence of the recirculation mentioned above.

Since the surging gives damages not only upon the turbo machine, but also upon conduits or pipes which are connected to an upper-stream side and a down-stream side thereof, ordinarily, it is inhibited to be practiced in a region of low flow rate. Further, there were already proposed the following methods for suppressing the surging, other than an improvement made in the shape (i.e., profile) of the blade, for the purpose of expanding or enlarging the operation region of the turbo machine.

1. Casing treatment:

Thin or narrow grooves or drains, being from 10% to 20% of a chordal length of the blade, are formed in a casing region where the impeller lies, so as to improve a stall margin. Namely, with the casing treatment which were already proposed, the grooves being sufficient in the depth are formed in an inner wall (i.e., flow surface) of the casing in the region where the blades lie, in an axial direction, in a peripheral direction, or in an oblique direction, alternatively, in a radial direction or an oblique direction, respectively.

2. Separator:

A separator is provided for dividing the recirculation flow occurring at the outer edge of the inlet of the impeller into a reverse flow portion and a forward flow portion (i.e., in a main flow direction), in the region of low flow rate, thereby prohibiting the expansion of the recirculation.

As an example of a separator which is applied into the turbo machine of the axial flow type, in particular, there are proposed a suction ring type, a blade separator type, and an air separator type.

In the suction ring type, the reverse flow is enclosed within an outside of the suction ring, and in the blade separator type is provided a fin between the casing and the ring. Further, with the air separator type, a front end or a tip of the moving wing (i.e., the blade) is opened so as to introduce the reverse flows into the outside of the casing, thereby prohibiting the swirl from being generated due to the reverse flows by means of the fin. Thus, it is more effective, comparing with the former two types mentioned above, however, it comes to be large-scaled in the devices thereof.

3. Active control:

This is to suppress the generation of the swirl due to the recirculation by injecting or spouting out the high pressure fluid from an outside into a spot where the recirculation occurs.

Furthermore, as an example of the conventional turbo machines, a mixed-flow pump will be described hereinafter. To a mixed-flow pump, it is required to show a head-flow rate characteristic curve (hereinafter, called by "head curve") having no behavior uprising at the right-hand side for enabling a stable operation, in a case where the pump is operated over the whole flow range thereof. However, ordinarily in a pump, it is common that the characteristics, such as an efficiency representing performance of the pump, a stability of the head curve, a cavitation performance, and an axial motive power for closure, etc., are in reversed relationships to one another. Namely, if trying to improve one of those characteristics, the other one(s) is is decreased down, therefore there is a problem that it is difficult to obtain improvements in at least two or more characteristics at the same time. For example, with a pump in which consideration was made primarily onto the efficiency thereof, the head curve shows a remarkable behavior uprising at the right-hand side in a portion thereof, thereby it has a tendency to be unstable.

For obtaining a head curve continuously falling down at the right-hand side for enabling the stable operation, in the conventional arts, as is mentioned in the above, it is already known that the casing treatment or the separator is provided or treated therein. Such the structure is already described, for example in U.S. Pat. No. 4,212,585.

Also, other than those, there is proposed a turbo machine, in which are formed plural pieces of grooves on the flow surface of the casing, for connecting between an inlet side of the impeller and an area or region of the flow surface of the casing where the blades reside, thereby obtaining a head curve having no such the characteristic of uprising at the right-hand side while suppressing the recirculation in the inlet thereof.

However, in accordance with the casing treatment and the separators of the prior arts mentioned above, although it is possible to shift the characteristic curve between head and flow rate including the portion uprising at the right-hand side into the lower flow rate side as it is, so as to expand the stable operation region thereof, however it is impossible to remove or cancel such the characteristic or behavior uprising at the right-hand side. Further, the turbo machine is decreased down by approximately 1% in the efficiency thereof, if it rises up by an every 10% in the stall margin, in accordance with the casing treatment.

Also, in such the active control, since there is a necessity to obtain the high pressure fluid from the turbo machine itself or an outside thereof, the efficiency of the turbo machine is decreased down as a whole system thereof.

Further, with a turbo machine, in which the grooves are formed for connecting between the inlet side of the impeller and the flow surface of the casing where the blades thereof reside, the processing of the grooves is easy and has a less decrease in an efficiency thereof, and it is also possible to obtain the head curve without such the uprising at the right-hand side in the characteristic thereof. However, there is not taken a consideration into a possibility that a fluctuation is generated in pressure due to interference between the flow from the blades of the impeller and the grooves when the blades pass by the plural grooves formed on the flow surface of the casing, thereby increasing vibration and noises.

SUMMARY OF THE INVENTION

An object, in accordance with the present invention, is to provide a turbo machine having a head-flow rate characteristic, which is improved in that of uprising at the right-hand side thereof, and enabling to suppress the decrease down of the efficiency thereof and further to suppress the increase up in the vibration and noises thereof.

Another object, in accordance with the present invention, is to provide a turbo machine, having an improved head-flow rate characteristic with respect to the turbo machine having a closed impeller, and enabling to suppress the decrease down of the efficiency thereof and the increase up in the vibration and noises thereof.

First, according to the present invention, for accomplishing the above-mentioned object, there is provided a turbo machine comprising: a casing; an impeller having a plurality of blades and being positioned within said casing; a plurality of first grooves being formed on an inner flow surface of said casing for conducting between an inlet side of said impeller and an area of the inner flow surface of said casing where the blades of said impeller reside in; and a second groove being formed on the inner flow surface of said casing for connecting said plurality of first grooves in a circumferential direction of said casing.

According to the present invention, it is preferable that in the turbo machine as defined in the above, wherein said plurality of first grooves are formed to be equal or greater than 5 mm in width, so that a total width of said plurality of the first grooves comes to be about 30%–50% with respect to a length of an inner circumference of the inner flow surface of said casing where the blades of said impeller reside in, and to be equal or greater than 2 mm in depth, so that it comes to be about 0.5%–1.6% with respect to a diameter of the inner flow surface of said casing where the blades of said impeller reside in.

Further, according to the present invention, it is preferable that in turbo machine as defined in the above, wherein said second groove is formed on the inner flow surface of said casing where the blades of said impeller reside in. And, also it is preferable that in turbo machine as defined in the above, wherein said second grooves are formed to be equal or shallower than said first grooves in depth thereof.

Further, according to the present invention, it is preferable that in turbo machine as defined in the above, wherein said second groove is formed from terminal ends of said first grooves at a down-stream side of said turbo machine, on the inner flow surface of said casing, up to the area where the blades of said impeller reside in, or up to the inlet side of said impeller.

Second, according to the present invention, there is provided a turbo machine comprising: a casing; an impeller having a plurality of blades and being positioned within said casing; and a plurality of grooves in a direction of pressure gradient of fluid, being formed on an inner flow surface of said casing, for communicating between an inlet side of said impeller and an area of the inner flow surface of said casing where the blades of said impeller reside in, wherein said grooves are formed in the direction of gradient in pressure of fluid so that they are inclined into a direction of rotation of said impeller, toward from a vicinity of an inlet portion of the impeller to a down-stream side of said turbo machine.

Third, according to the present invention, there is provided a turbo machine comprising: a casing; an impeller having a plurality of blades and being positioned within said casing; a plurality of first grooves in a direction of gradient in pressure of fluid, being formed on an inner flow surface of said casing at an inlet side of said impeller, over an inner circumference thereof; a second groove being formed on the inner surface of said casing, within an area where the blades of said impeller reside in, directing in a circumferential direction thereof; and a flow passage for connecting between said first grooves and said second groove.

Further, according to the present invention, in the turbo machine as defined in the above, wherein said flow passage is constructed with a groove, a bore, a conduit or a tube, etc., being formed bypassing the inner surface of said casing.

Fourth, according to the present invention, there is provided a turbo machine comprising: a casing; an impeller having a plurality of blades and being positioned within said casing; a plurality of first grooves in a direction of gradient in pressure of fluid, being formed on an inner surface of said casing at an inlet side of said impeller, over an inner circumference thereof; a second groove being formed on the inner surface of said casing within an area where the blades of said impeller reside in, directing in a circumferential direction thereof; and a third groove being formed on the inner surface of said casing in a vicinity of a front edge of the blades of said impeller, directing in the circumferential direction thereof; and a flow passage for connecting between said second groove and said third groove, wherein said flow passage is formed on a line extending from said first groove, bypassing the inner surface of said casing, so as to be communicated with said first groove through said third groove.

Fifth, according to the present invention, there is provided a turbo machine comprising: a casing; an impeller having a plurality of blades and being positioned within said casing; a plurality of grooves in a direction of gradient in pressure of fluid, being formed on an inner flow surface of said casing over an inner circumference thereof, for communicating between an inlet side of said impeller and an area of the inner flow surface of said casing where the blades of said impeller reside in; and movable members provided within said grooves in the direction of gradient in pressure of fluid, being movable in a radial direction of said casing so as to change depth of said grooves.

Sixth, according to the present invention, there is provided a turbo machine comprising: a closed-type impeller having a plurality of blades and a shroud thereabouts; a casing having an inner flow wall and receiving said impeller therein, wherein said impeller is formed into an open-type having no shroud thereabouts in vicinity of an inlet of said impeller; and a plurality of first grooves in a direction of gradient in pressure, being formed on an inner flow wall of said casing, opposing to a portion of said impeller having no shroud thereabouts in vicinity of the inlet thereof, over an inner circumference thereof, wherein a starting end of said first grooves at an inlet side is positioned at an upper flow side than a tip inlet side of said impeller, while a terminal end of said first grooves is positioned at a lower flow side than the tip inlet side of said impeller; and further comprising: a second groove for connecting said plurality of the first grooves in the circumferential direction of said casing, being formed on the inner flow wall of said casing, opposing to the portion of said impeller having no shroud thereabouts in vicinity of the inlet thereof.

Seventh, according to the present invention, there is provided a turbo machine comprising: an impeller; a casing receiving said impeller therein; a plurality of first grooves in a direction of gradient in pressure of fluid, being formed on an inner flow surface of said casing, opposing to an outer peripheral portion of blades of said impeller at an inlet side thereof, for connecting between an area where recirculation occurs at the inlet side of said impeller when flow rate is low and an area on the inner flow surface of said casing where tips of the blades of said impeller reside in, wherein terminals of said first grooves at a down-stream side of the turbo machine are positioned so that fluid of pressure can be taken out for suppressing a generation of the recirculation within a main flow, in inlets of said first grooves at an upper-stream side of the turbo machine; and a second groove being formed on the inner flow surface of said casing in a vicinity of the inlet of said impeller, for connecting said plurality of first grooves in a circumferential direction thereof, wherein portions of said casing where said first and second grooves are provided are formed as a body being separated from other portion of said casing.

According to the present invention, with the provision of the second groove(s), being formed in the area of said grooves where the impeller blades reside in, to be shallower, equal to or deeper than the first grooves in the depth, for making a portion of the first grooves continuous in the circumferential direction, the fluctuation in pressure, being caused due to the interference between the grooves and the flow from the impeller when the impeller blades pass by the grooves in the direction of gradient in pressure, is reduced or mitigated, thereby it is possible to suppress generation of the vibration and/or noises caused by the fluctuation in pressure.

Further, with forming the grooves in the direction of gradient in pressure (i.e., the first grooves), being inclined into the direction of rotation of said impeller (i.e., being wound into a reverse direction of curving of the impeller blades), it is also possible to reduced or mitigated the interference between the flow from the impeller and the grooves.

Further, the same effect can be obtained by forming the first grooves in the direction of gradient in pressure up to the inlet of the impeller, but constructing them not to overlap the second grooves in the circumferential direction, so that the grooves in the circumferential direction and the grooves in the direction of gradient in pressure are communicated with each other, thereby to take out the fluid of pressure for suppressing a generation of the recirculation within the main flow at the inlet of the impeller. Those two kinds of grooves mentioned above are preferable to be connected through the flow passages, being formed on the outer periphery of the casing escaping from the inner flow surface thereof where the main flow flows through. In this manner, it is possible to provide no such the grooves in the direction of gradient in pressure within the area on the inner flow surface of the casing where the impeller blades reside in, thereby enabling to reduce or mitigate the interference between the flow from the impeller and the grooves. The flow passages for connecting between the first grooves and the second grooves are preferably to be formed on the lines elongating from the first grooves, so that the fluid in the reverse direction against the main flow flows into the inlet side of the impeller blades.

Other features, objects and/or advantages obtained according to the present invention, will be apparent from the following explanation which will be made by referring to accompanying drawings.

DESCRIPTION OF PREFERRED EMBODIMENTS

Hereinafter, embodiments according to the present invention will be fully explained by referring to the attached drawings.

Figure 1:
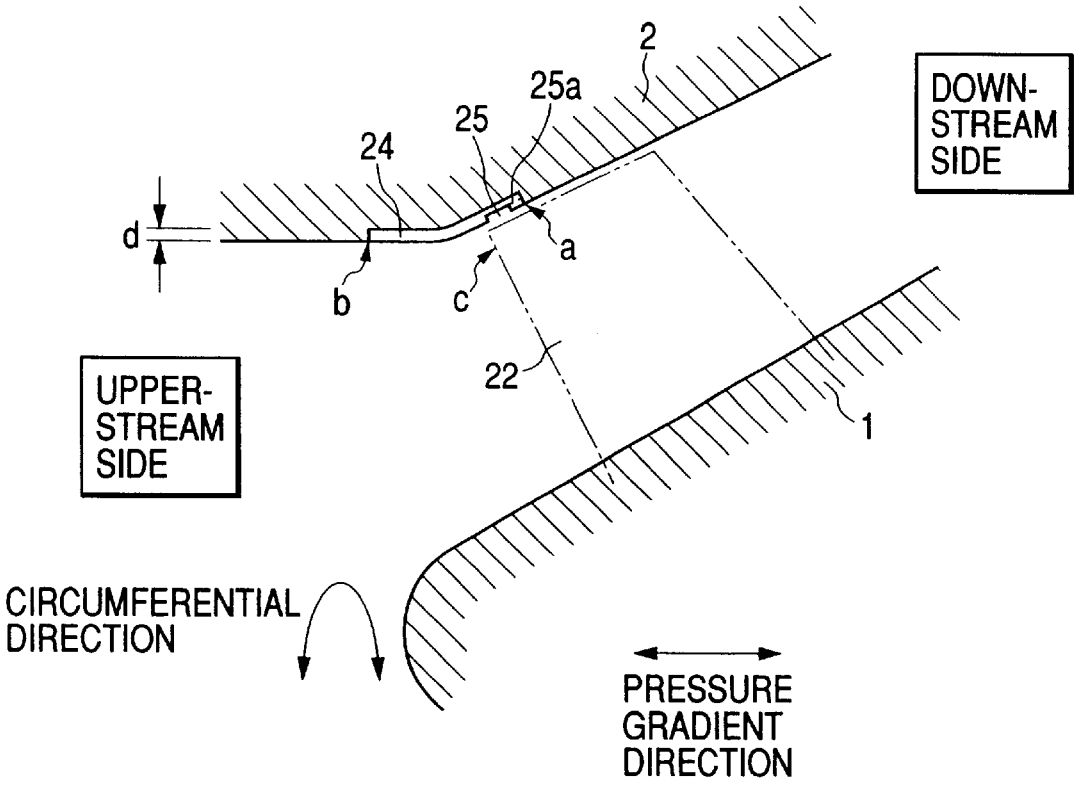
FIG. 1 is a meridian plane view of a principle portion of a mixed-flow pump, according to a first embodiment of the present invention.

FIG. 1 shows a first embodiment of the present invention. The figure is an enlarged cross-section view of a portion of an impeller portion of a mixed-flow pump, as a representative one of the turbo machines, wherein a reference numeral 1 indicates an impeller of an open type, having open blades therewith. For suppressing generation of the recirculation due to the reserve flow from the blades of the impeller, a large number of shallow grooves (i.e., first grooves) 24 in a direction of pressure gradient of fluid are formed on an inner flow surface of a casing 2 around an outer circumference thereof, in the vicinity of an inlet portion of the blades 22 of the impeller. A terminal position a of this groove at a down-stream side of the turbo machine lies in an area where the impeller blades resides in, thereby conducting a portion of a fluid compressed by the impeller to the position b where the recirculation is generated when the flow rate is low at an upper-stream side of the turbo machine through this groove 24. With this, since the compressed fluid at the down-stream side is spouted out in a position where the recirculation is easily generated, it is possible to suppress the generation of the recirculation, and to suppress a main flow at an inlet of the turbo machine to turn into the swirl due to an influence of the recirculation, thereby achieving a turbo machine having a high performance therewith, being prohibited from generation of stall of rotation of the impeller blades.

Also, according to the present embodiment, a plurality of second grooves 25 are also formed on the inner flow surface of the casing, for making the plurality of first grooves 24 formed over the inner circumference thereof continuous, at a portion thereof corresponding to the area where the impeller blades reside in. In a case where no such the second groove is formed, it is acknowledged that a flow from the impeller 1 interferes with the first grooves 24 formed in an axial direction (i.e., in the pressure gradient direction of fluid), thereby generating a fluctuation in pressure. The fluctuation generated in pressure vibrates the turbo machine, and increases vibration and noises. According to the present embodiment, since the second grooves 25 in the circumferential direction of the casing are formed within the area where the impeller blades reside in, the difference in pressure between the first grooves 24, which are formed in the plurality thereof over the inner circumference thereof, is mitigated within the second grooves 25, therefore it is possible to make the fluctuation in pressure which is caused by the first grooves 24 and the blades 22 small, i.e., to suppress the increase of the vibration and noises due to the fluctuation in pressure.

Figure 2:
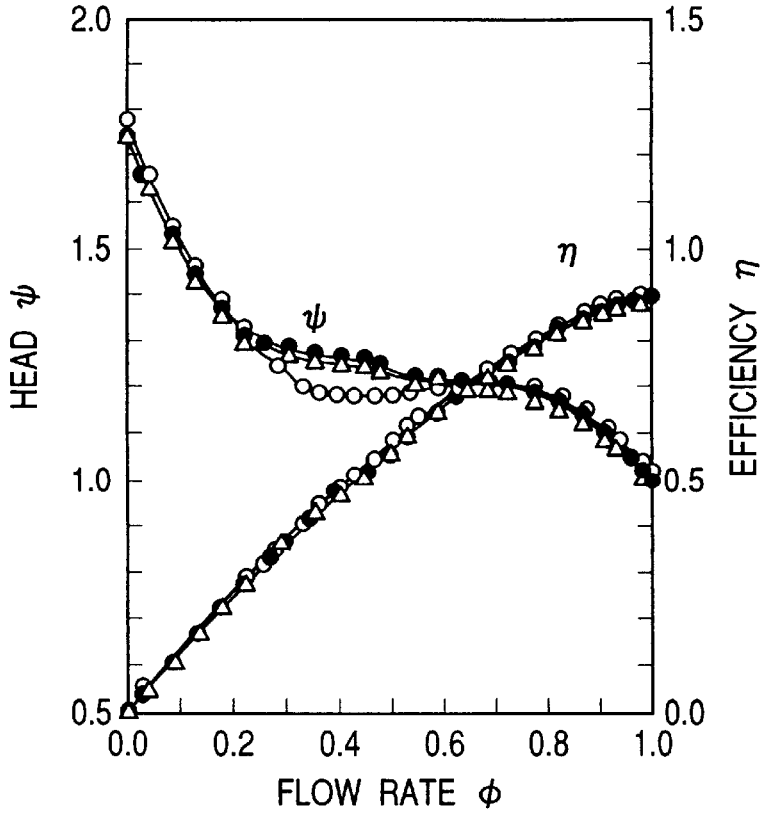
FIG. 2 shows a graph of showing a head-flow rate characteristic curve of a turbo machine and an efficiency-flow rate characteristic curve, respectively.

FIG. 2 shows a graph of showing a head-flow rate characteristic curve of a turbo machine and an efficiency-flow rate characteristic curve thereof, wherein the horizontal axis indicates a flow rate without dimension thereof while the vertical axis a head without dimension thereof. In the figure, white circles indicate the head-flow rate characteristic curve and the efficiency-flow rate characteristic curve of a turbo machine, in which no such the first grooves 24 is formed on the inner flow surface around the casing. Black circles indicate the head-flow rate characteristic curve and the efficiency-flow rate characteristic curve of a turbo machine, in which the first grooves 24 are formed. White triangles indicate the head-flow rate characteristic curve and the efficiency-flow rate characteristic curve of a turbo machine, in which the first grooves 24 are formed and also the second grooves 25 are formed in the vicinity of the terminal position a of the grooves 24 at the down-stream side of the turbo machine.

As is apparent from the FIG. 2, in the case of those white circles, within a region from 0.5 to 0.6 in the non-dimensional flow rate, there is a characteristic of uprising at the right-hand side wherein the head increases following the increase of the flow rate. In the case of black circles, the characteristic of uprising at the right-hand side is dissolved. In the case of the white triangles, according to the present embodiment, an effect being same to that of the black circles is confirmed.

Figure 3:
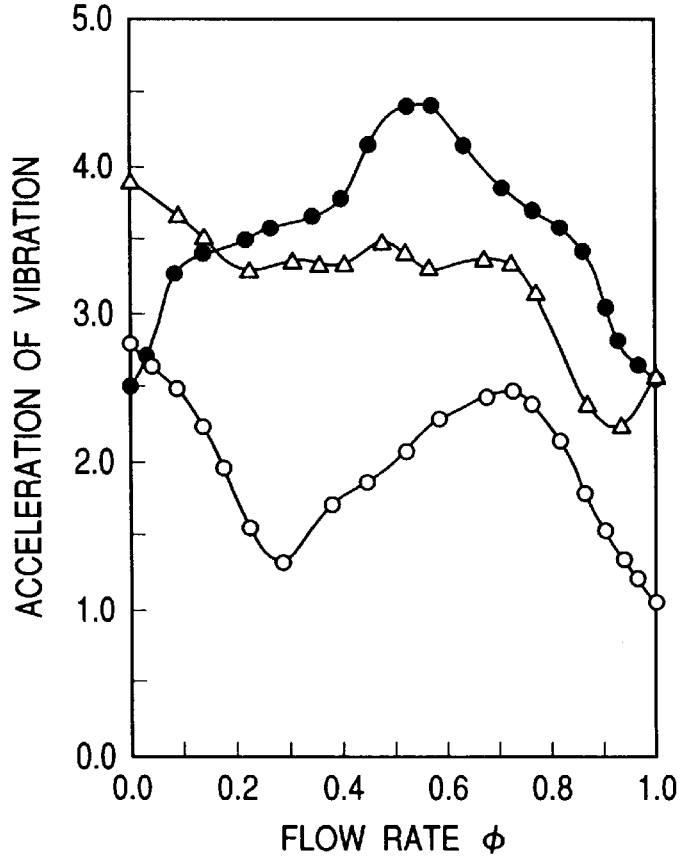
FIG. 3 shows a graph of showing a relationship between a flow rate and an acceleration of vibration of a turbo machine.

FIG. 3 shows a relationship between the flow rate and an acceleration of vibration in the turbo machine, wherein the white circles, the black circles and the white triangles indicate data on the turbo machine being same to that shown in the FIG. 2, respectively. In the figure, the horizontal axis indicates the flow rate without dimension thereof, while the vertical axis the acceleration of vibration without dimension thereof. As is apparent from this FIG. 3, comparing to that of the white circles, the vibration acceleration shows a peak in the vicinity of 0.5–0.6 of the non-dimensional flow rate in a case of the black circles where the first grooves are formed, and comparing to the case of the white circles, the vibration is increased up over a whole range thereof. On the contrary to this, in the case of the white triangles where the first and the second grooves are formed, it is apparent the vibration acceleration is improved greatly, comparing to that of the black circles, and that the acceleration of vibration shows no such the peak in the vicinity of 0.5–0.6 of the non-dimensional flow rate, thereby the vibration is also improved, greatly.

Figure 4:
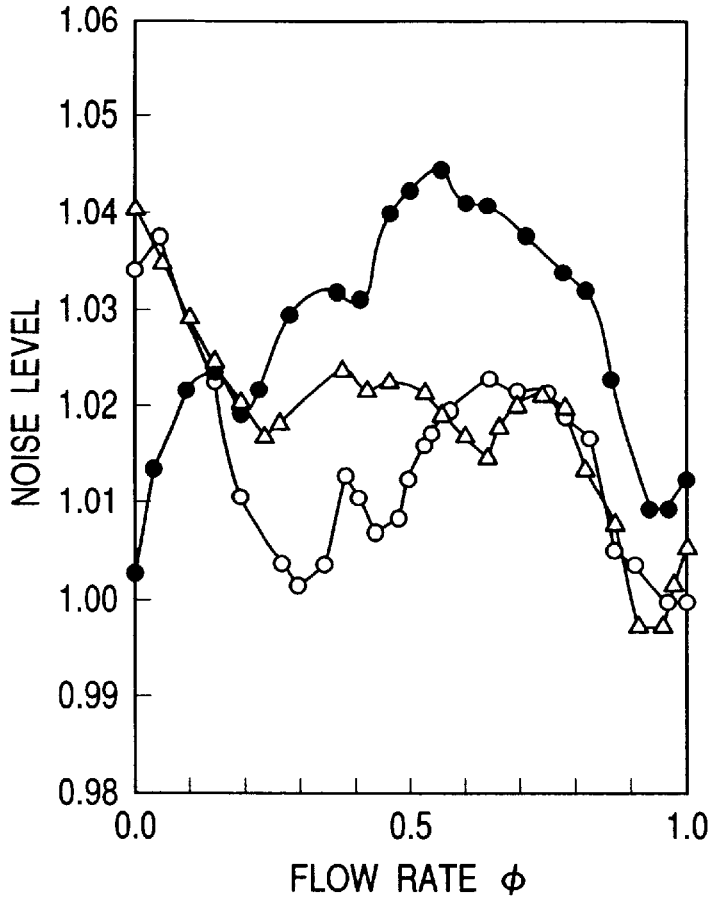
FIG. 4 shows a graph of showing a relationship between a flow rate and a noise level of vibration of a turbo machine.

FIG. 4 shows a relationship between the flow rate and a noise level in the turbo machine, wherein the white circles, the black circles and the white triangles indicate data on the turbo machine being same to that shown in the FIG. 2, respectively. In the figure, the horizontal axis indicates the flow rate without dimension thereof, while the vertical axis the noise level without dimension thereof. As is apparent from this FIG. 4, comparing to that of the white circles, the noise level is increased up in the case of the black circles. On the contrary to the case where only the first grooves are formed, it is apparent that the noise level is greatly reduced, down to around a degree being same to the case (of the white circles) where no such groove is formed in the casing, within a range of the flow rate of showing a high efficiency as a main operation range of the pump, in the case of the white triangles (according to the present embodiment) where the first and the second grooves are formed.

However, in the embodiment shown in the FIG. 1, the second grooves 25 in the circumferential direction are formed at a depth being shallower than the depth d of the first grooves 24 in the pressure gradient direction, and are communicating all or several of the first grooves which are formed in a large number thereof over the inner circumference of the casing.

Further, the depth of those second grooves 25 in the circumferential direction may be equal to the depth d of the first grooves 24 in the pressure gradient direction, and further it may be made larger than the depth d of the first grooves.

Figure 5:
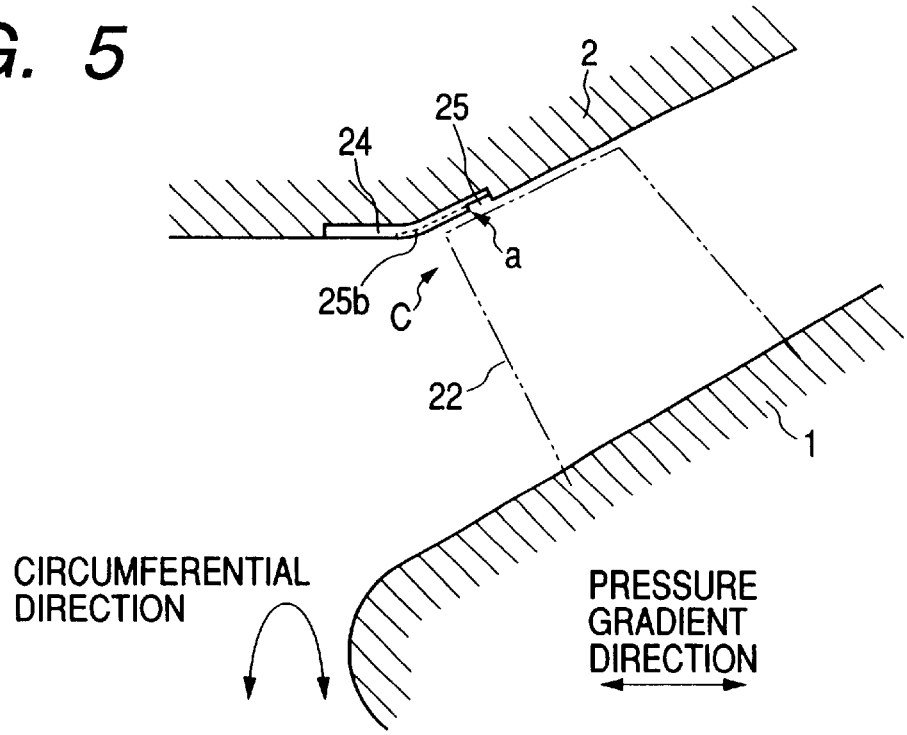
FIG. 5 is a meridian plane view of a principle portion of a turbo machine of showing a variation of the embodiment shown in the FIG. 1, according to the present invention.

Also, with the position where the second grooves 24 in the circumferential direction are formed, though they start from the vicinity of the front edges c of the impeller blades 22 until a position located at the upper-stream side a little bit from the terminal position a of the grooves, directing into the down-stream side of the turbo machine, in the example shown in the FIG. 1, however they may be from the vicinity of the front edges C of the impeller blades 22 until the terminal position a of the grooves, directing into the down-stream side of the turbo machine (see a dotted line 25*a*). Further, as shown in FIG. 5, the second grooves 25 may be provided starting from the terminal position a of the grooves until an area located at the upper-stream side a little bit therefrom, where the impeller blades reside in, or they may be formed starting from the terminal position a of the grooves until the position at the upper-stream side of the turbo machine than the front edges C of the blades 22.

Figure 6:
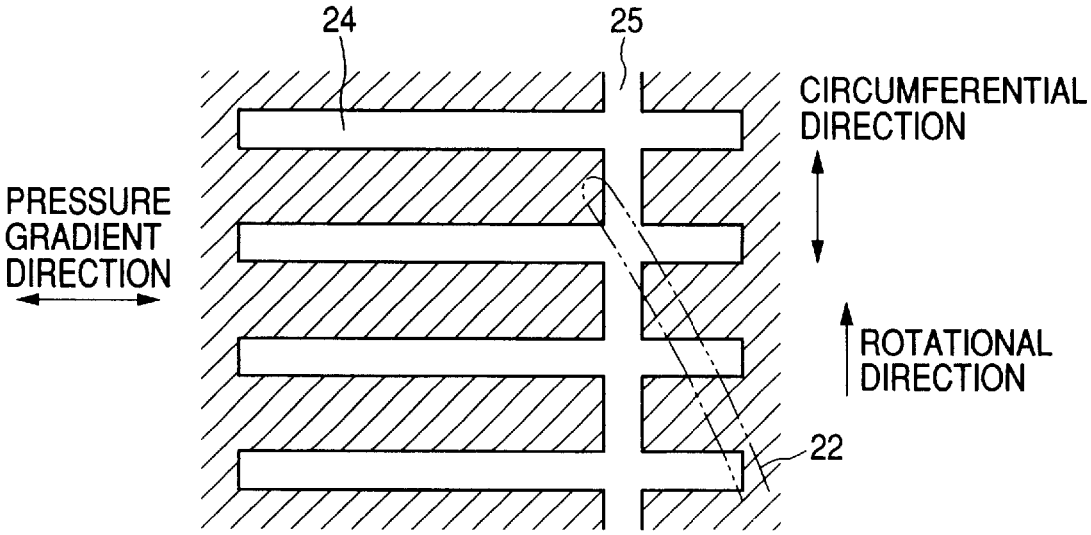
FIG. 6 is an extended view of an inner flow surface of a casing shown in the FIG. 1.
Figure 7:
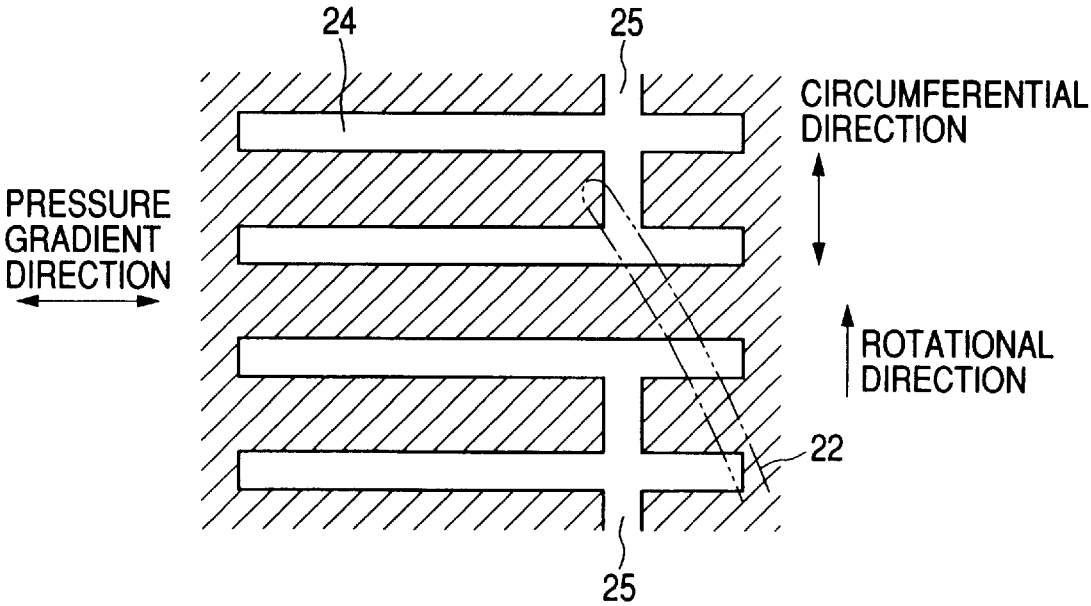
FIG. 7 is an extended view of an inner flow surface of a casing for showing a variation of an example shown in the FIG. 6.
Figure 8:
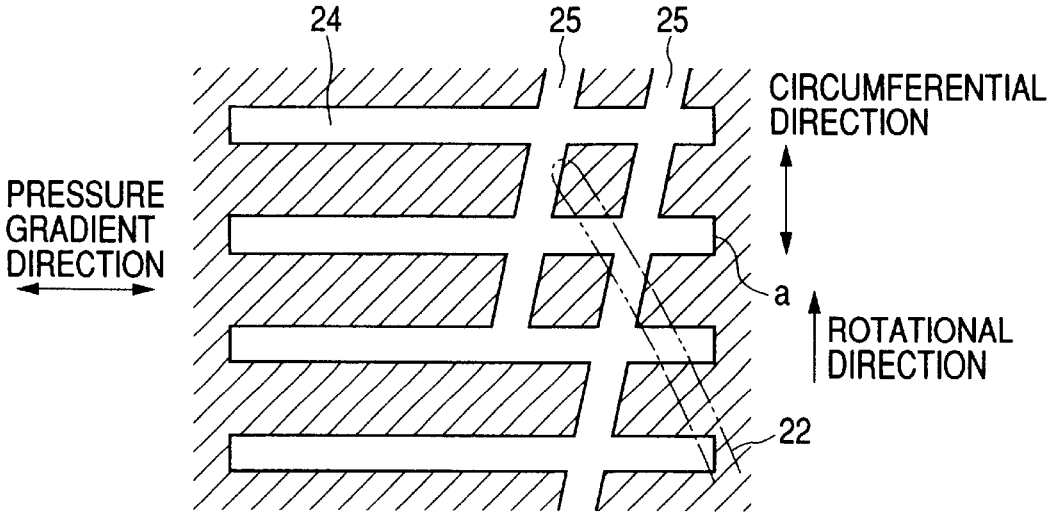
FIG. 8 is an extended view of an inner flow surface of a casing for showing another variation of the example shown in the FIG. 6.

FIG. 6 shows an extended view of the inner flow surface of the casing shown in the FIG. 1, and as is shown in this figure, the second grooves 25 in the circumferential direction of the casing are communicating all the first grooves 24 in the pressure gradient direction, which are formed over the inner circumference of the casing in a large number thereof, in the circumferential direction thereof. The second grooves 25 in the circumferential direction of the casing may be formed intermittently, as shown in FIG. 7, in a number of pieces thereof, in the circumferential direction thereof, in such a manner that the large number of the first grooves in the pressure gradient direction which are formed over the inner circumference thereof are communicated (or connected) by a several number thereof. Further, as is shown in FIG. 8, the second grooves 25 in the circumferential direction may be formed in a spiral shape starting from the vicinity of the inlet portion of the impeller blades until the terminal position a of the first grooves 24, so that the first grooves 24 in the pressure gradient direction are communicated to one another in the circumferential direction of the casing.

Figure 9:
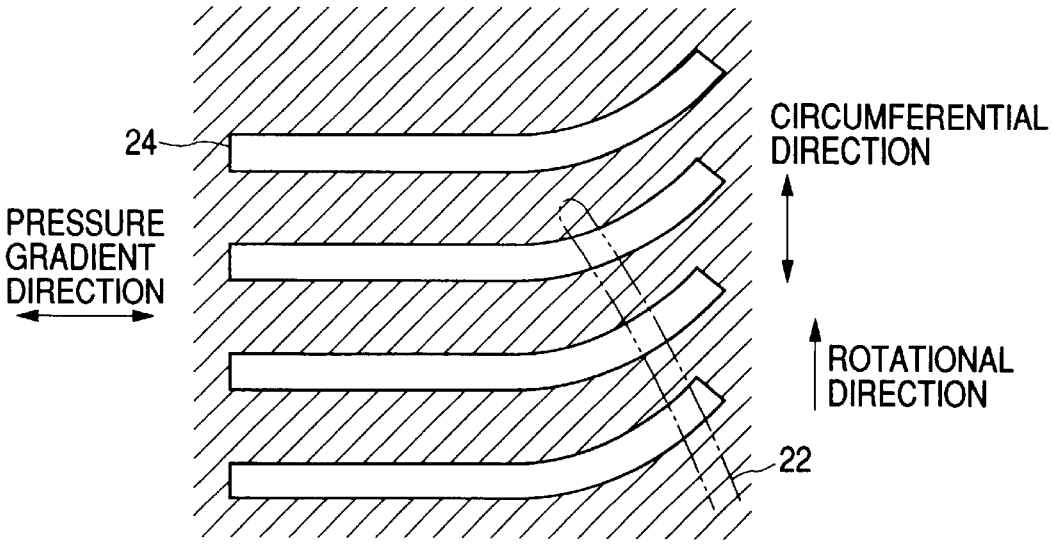
FIG. 9 is an extended view of an inner flow surface of a casing for showing a second embodiment according to the present invention.

Next, explanation will be given on a second embodiment according to the present invention, by referring to FIG. 9.

Also in the present embodiment, it is same to the first embodiment mentioned above in an aspect that the plurality of grooves 24 in the pressure gradient direction (i.e., the axial direction) are formed for communicating between the inlet side of the impeller blades and the area on the inner flow surface of the casing. In this embodiment, a portion of the grooves 24 corresponding to the above-mentioned area where the impeller blades reside (i.e., the down-stream side of the blades) are inclined (or wound) into a direction of rotation of the impeller. With such the structure, the interference between the impeller blades 22 and the grooves 24 is made slow or loose, thereby it is possible to reduce generation of the fluctuation in pressure, and also to suppress the increase of the vibration and noises. Also, the grooves 24 at the upper-stream side of the impeller blades are formed in an axial direction of the casing, and the fluid flows back to the inlet side of the impeller blades through those grooves 24 when the pressure is increased by the blades, so as to be spouted out at the position where the recirculation occurs when the flow rate is low, therefore it is possible to suppress the circulation and/or the stall of rotation of the impeller blades caused due to the recirculation, thereby to dissolve or reduce the characteristic of uprising at the right-hand side in the head-flow rate characteristic curve of the turbo machine.

Figure 10A:
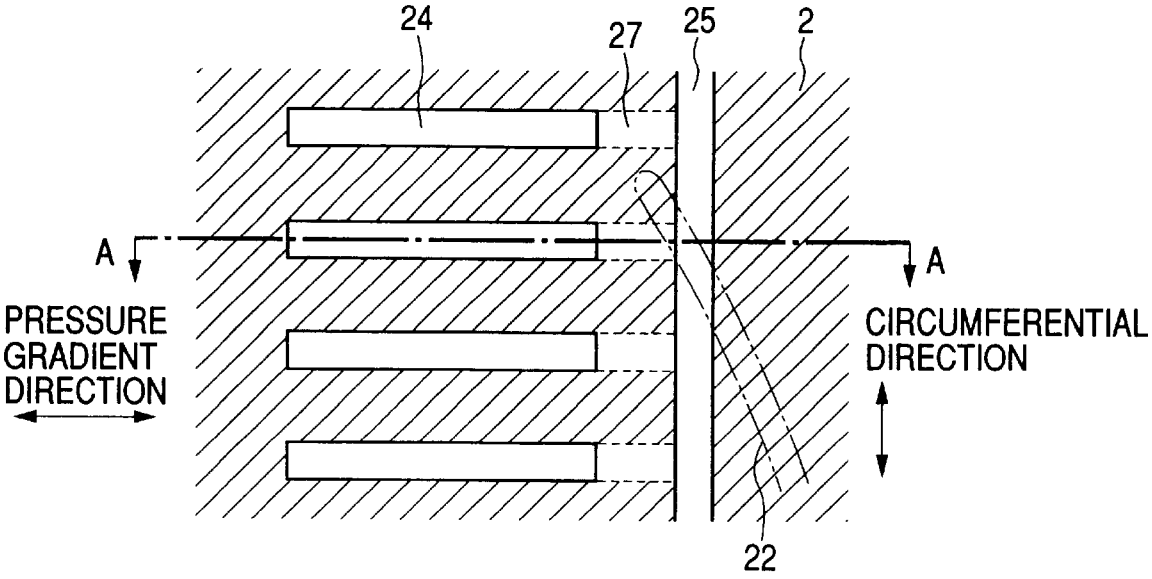
FIGS. 10(*a*) and (*b*) show a third embodiment according to the present invention, in particular, the FIG. 10(*a*) shows an extended view of an inner flow surface of a casing, and the FIG. 10(*b*) shows a A—A cross-section view (a meridian plane view) of the FIG. 10(*a*)
Figure 10B:
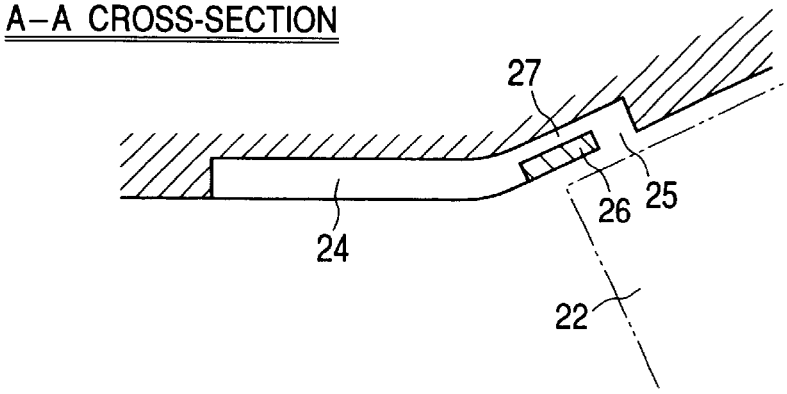

FIGS. 10(*a*) and (*b*) show views of a third embodiment according to the present invention. The FIG. 10(*a*) shows an extended view of the inner flow surface of the casing, and the FIG. 10(*b*) an A—A cross-section view on a meridian plane in the FIG. 10(*a*).

On the inner flow surface of the casing 2, a plurality of the first grooves 24 are formed over the inner circumference thereof, directing in the axial direction (i.e., in the pressure gradient direction) for connecting the inlet side of the impeller and the area where the impeller resides in, and also on the inner flow surface of the casing where the impeller resides in are formed second grooves 25, being continuous in the circumferential direction in a part thereof. Further, flow passages 27 are formed bypassing the inner flow surface of the casing, in such a manner that the above-mentioned first grooves 24 and the second grooves 25 are communicated with each other. The flow passages 27 are located or aligned on a line extending from the grooves 24, therefore a portion of the fluid compressed by the impeller blades flows through the second grooves 25 and the flow passages 27 into the first grooves 24, so as to be spouted out at the position where the recirculation occurs, at the inlet side of impeller blades. Thereby, in the same manner as in the embodiments mentioned above, it is possible to dissolve the characteristic of uprising at the right-hand side in the head-flow rate characteristic curve of the turbo machine.

Also, no such the grooves is formed on the inner flow surface of the casing, where the impeller resides in the axial direction thereof, therefore there occurs no such the interference in the flow when the blades pass by the first grooves, and further the difference in pressure is made small between the plurality of the first grooves 24 via the second grooves 25, thereby enabling to suppress the increase of the vibration and noises due to the fluctuation in pressure.

Figure 11A:
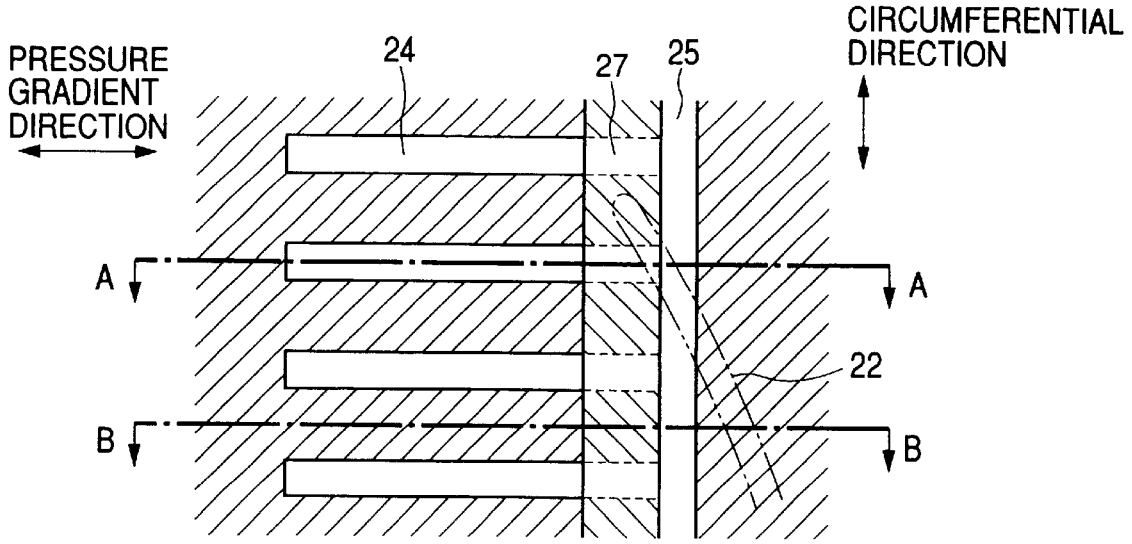
FIGS. 11(*a*) to (*c*) show a concrete example for achieving the structure of the third embodiment according to the present invention, in particular, the FIG. 11(*a*) shows an extended view of an inner flow surface of a casing, the FIG. 11 (*b*) shows a A—A cross-section view (a meridian plane view) of the FIG. 11(*a*), and FIG. 11(*c*) shows a B—B cross-section view (a meridian plane view) of the FIG. 11(*a*)
Figure 11B:
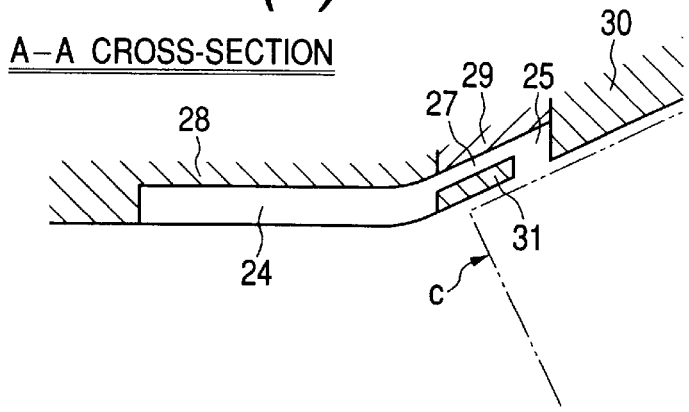
Figure 11C:
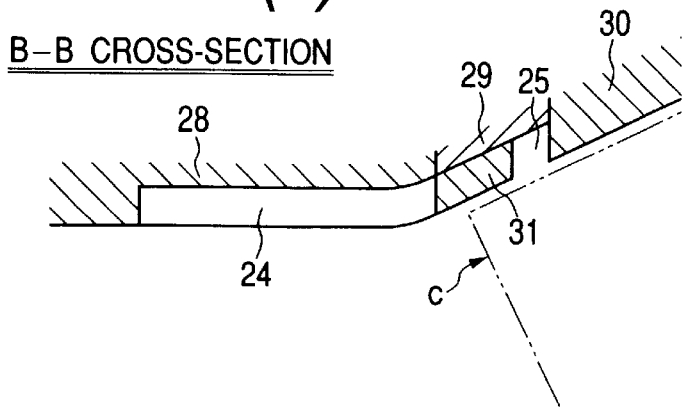

An example for realizing such the structure of the third embodiment mentioned above will be explained, by referring to FIGS. 11(*a*) to (*c*). The FIG. 11(*a*) shows an extended view of the inner flow surface of the casing, the FIG. 11 (*b*) an A—A cross-section view (i.e., a cross-section view on a meridian plane) in the FIG. 11(*a*), and FIG. 11(*c*) a B—B cross-section view (i.e., a cross-section view on the meridian plane) in the FIG. 11(*a*).

The casing is divided into three portions as indicated by reference numerals 28, 29 and 30, in the axial direction. (Here, it does not matter if the portions 28 and 29 of the casing are formed as one or in a body, or alternatively if the portions 29 and 30 of the casing are formed as one or in a body.) On the inner flow surface of a casing 28, a plural number of the second grooves 24 directing into the axial direction (i.e., the pressure gradient direction) are formed over the inner circumference thereof, connecting from the inlet side of the impeller blades until the front edge c thereof. Also, at an inner periphery side of the casing portion 29 is inserted a circular or ring-like member (i.e., a casing) 31, thereby forming direction of circumference between an end surface of this circular member at the down-stream side of the turbo machine and an end surface of the casing 30. Also, on a reverse side surface of the circular member 31 mentioned above, flow passages 27 are formed in such a manner that the first and the second grooves 24 and 25 are communicated with each other. As shown in the FIG. 11(*c*), by connecting the inner flow surface of the casing 29 to an outer peripheral surface of a portion of the circular member 31 which does not form the grooves therewith, it is possible to fix the circular member 31 onto the inner flow surface of the casing member 29.

Figure 12:
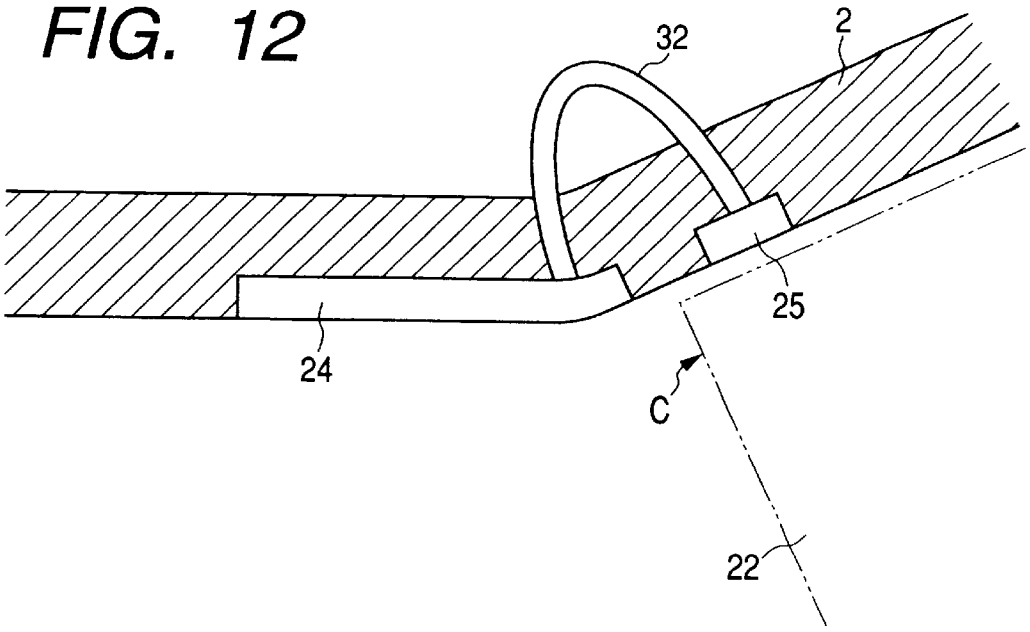
FIG. 12 is a meridian plane view of a principle portion of a turbo machine for showing a variation of the embodiment shown in the FIGS. 10(*a*) and (*b*)

Next, a variation of the embodiment shown in the FIG. 10 mentioned above will be shown in FIG. 12. An aspect differing from that shown in the FIGS. 10(*a*) and (*b*) lies in that the flow passage 32 provided bypassing the inner flow surface of the casing is constructed with a conduit or a tube. With this, through the second grooves 25 and the flow passages 32, the fluid compressed by the impeller blades flows back to the first grooves 24 against the main flow, thereby being spouted out in the position where the recirculation occurs.

Figure 13A:
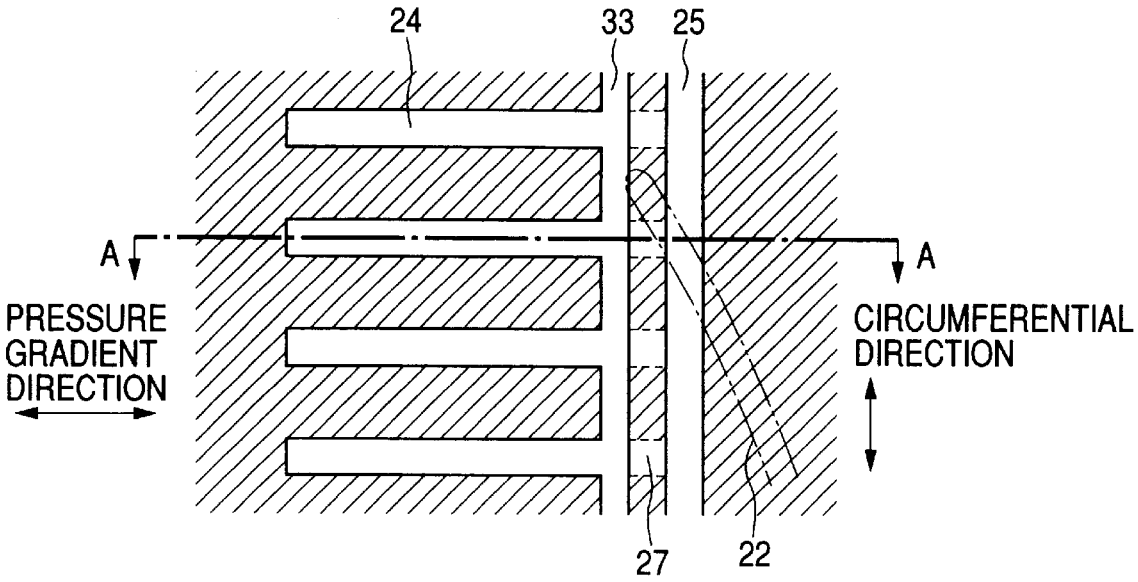
FIGS. 13(*a*) and (*b*) are views for showing anther variation of the embodiment shown in the FIGS. 10(*a*) and (*b*), in particular, the FIG. 13(*a*) shows an extended view of an inner flow surface of a casing, and the FIG. 13(*b*) shows a A—A cross-section view (a meridian plane view) of the FIG. 13(*a*)
Figure 13B:
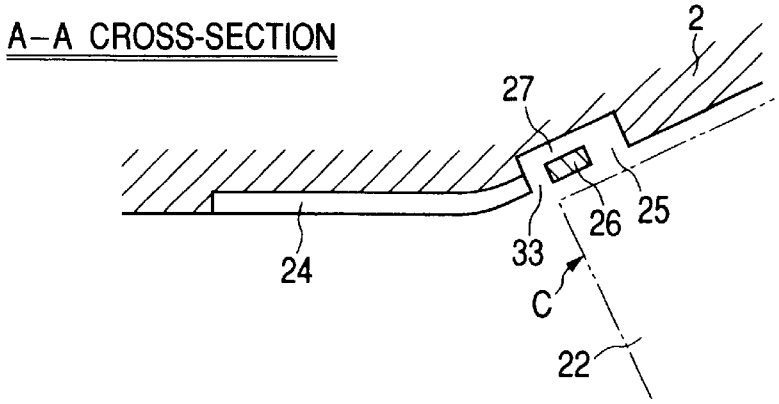

Another variation of the embodiment shown in the FIG. 10 mentioned above will be shown in FIGS. 13(*a*) and (*b*). The FIG. 13(*a*) shows an extended view of the inner flow surface of the casing, and the FIG. 13(*b*) an A—A cross-section view in the FIG. 13(*a*).

An aspect of this variation differing from that shown in the FIGS. 10(*a*) and (*b*) lies in that on the inner flow surface of the casing at the front edge c of the blades 22 is formed a third groove 33 in the circumferential direction thereof, for communicating the first grooves 24, which are formed into the axial direction in a large number thereof, into the circumferential direction thereof, separating from the second groove 25. The second groove 25 and the third groove 33 are communicated to each other through the flow passages 27, thereby being so constructed that the fluid compressed by the impeller blades 22 flows through the second grooves 25, the flow passages 27 and the third grooves 33 into the first grooves 24.

The fluctuation in pressure caused due to the interference when the blades 22 of the impeller pass by the first grooves 24 reduces the pressure difference between the first grooves 24 which are formed over the inner circumference of the casing in the plurality thereof, via the second grooves 25 and the third grooves 33, thereby enabling to suppress the increase of the vibration and noises caused due to the fluctuation in pressure within the turbo machine.

A fourth embodiment according to the present invention will be explained by referring to FIGS. 14(*a*) and (*b*).

In this embodiment, on the inner flow surface of the casing 2 are formed a plurality of shallow grooves 24 in the pressure gradient direction of fluid, for communicating between the inlet side and the area on the inner flow surface of the casing where the impeller resides in, and within each of those grooves 24, there is provided a movable member 34, which has a thickness being smaller than the depth of the groove, being movable in a radial direction (i.e., in a vertical direction). The movable member 34 is constructed to be positioned upon a curved surface being same to that of the inner flow surface of the casing 2.

Figure 14A:
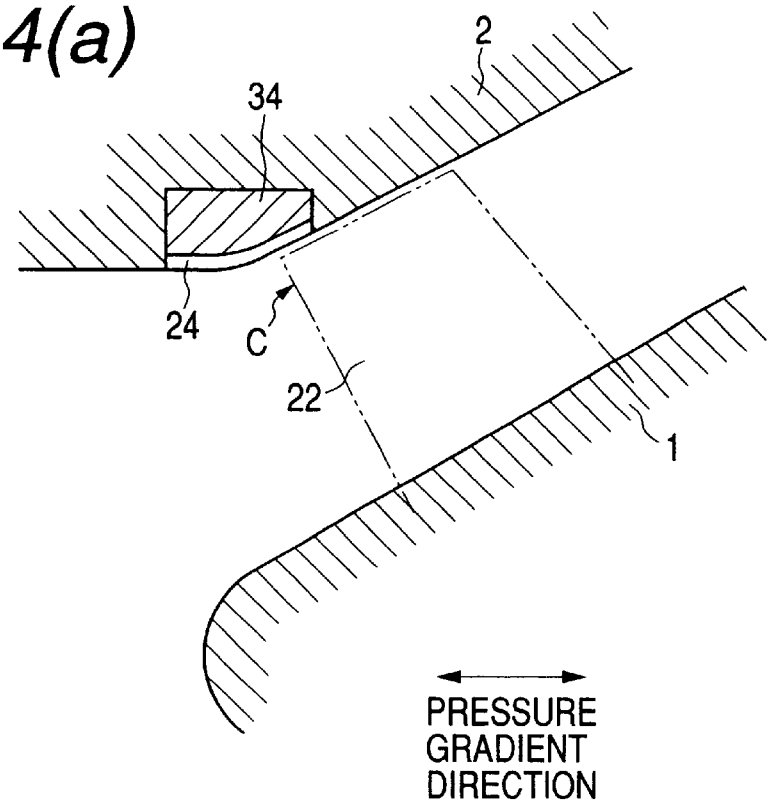
FIGS. 14(*a*) and (*b*) are views for showing a fourth embodiment according to the present invention, in particular, the FIG. 14(*a*) shows a condition that a movable member 34 is shifted in an outer diameter direction, and the FIG. 14(*b*) shows a condition that a movable member 34 is shifted in an inner diameter direction.
Figure 14B:
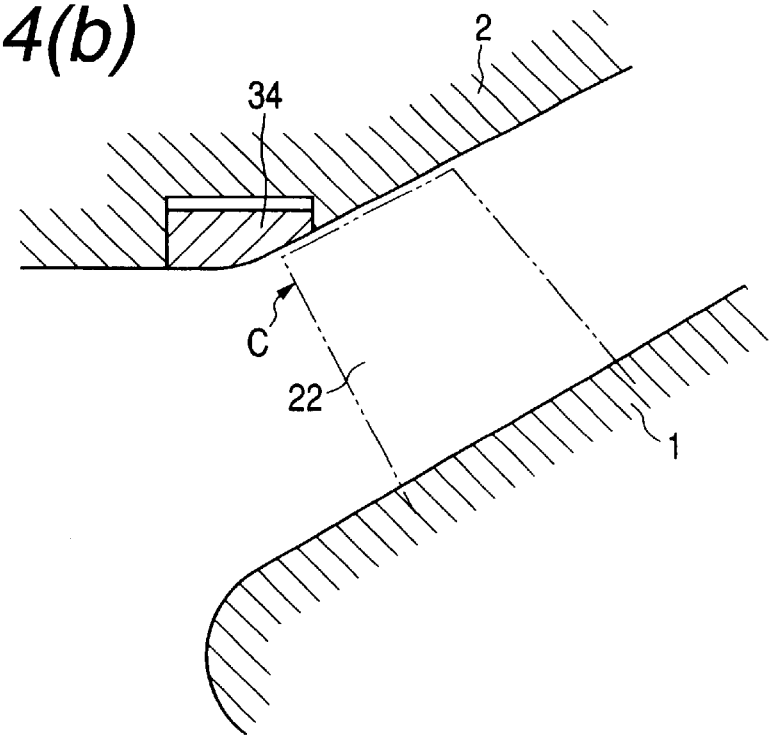

With such the structure according to the present embodiment, in an operation region where the characteristic of uprising at the right-hand side occurs in the head-flow rate characteristic curve of the turbo machine, the movable member 34 is shifted or moved in a direction of an outer diameter, as shown in the FIG. 14(*a*), thereby forming the shallow grooves 24 on the inner flow surface of the casing. With those shallow grooves 24, a portion of the fluid compressed by the impeller blades 22 passes through the grooves 24 and flows back into the main flow, and is spouted out into the region where the recirculation occurs at the inlet of the impeller blades, so as to suppress generation of the circulation at the inlet side of the impeller, as well as the stall of rotation of the impeller blades, thereby enabling to dissolve or reduce the characteristic of uprising at the right-hand side in the head-flow rate characteristic curve of the turbo machine.

Also, in the operation region where the characteristic of uprising at the right-hand side occurs in the head-flow rate characteristic curve, as shown in the FIG. 14(*b*), the movable member 34 is shifted or moved in the direction of an inner diameter so that an inner surface of the movable member comes to be coincident with the inner flow surface of the casing, thereby bringing about a condition that there is no such the shallow grooves thereon. With doing so, since it is possible to bring the inner flow surface of the casing into the condition that no such the grooves is formed thereon in the operating region where no such the characteristic of uprising at the right-hand side mentioned above occurs, the interference of the fluid due to the blades and the grooves in the axial direction can be release from, thereby dissolving the fluctuation in pressure.

In this manner, according to the present embodiment, there can be obtain an effect that the vibration and noises generated due to influence of the grooves in the axial direction can be dissolved, all over the range of flow rate.

Figure 15:
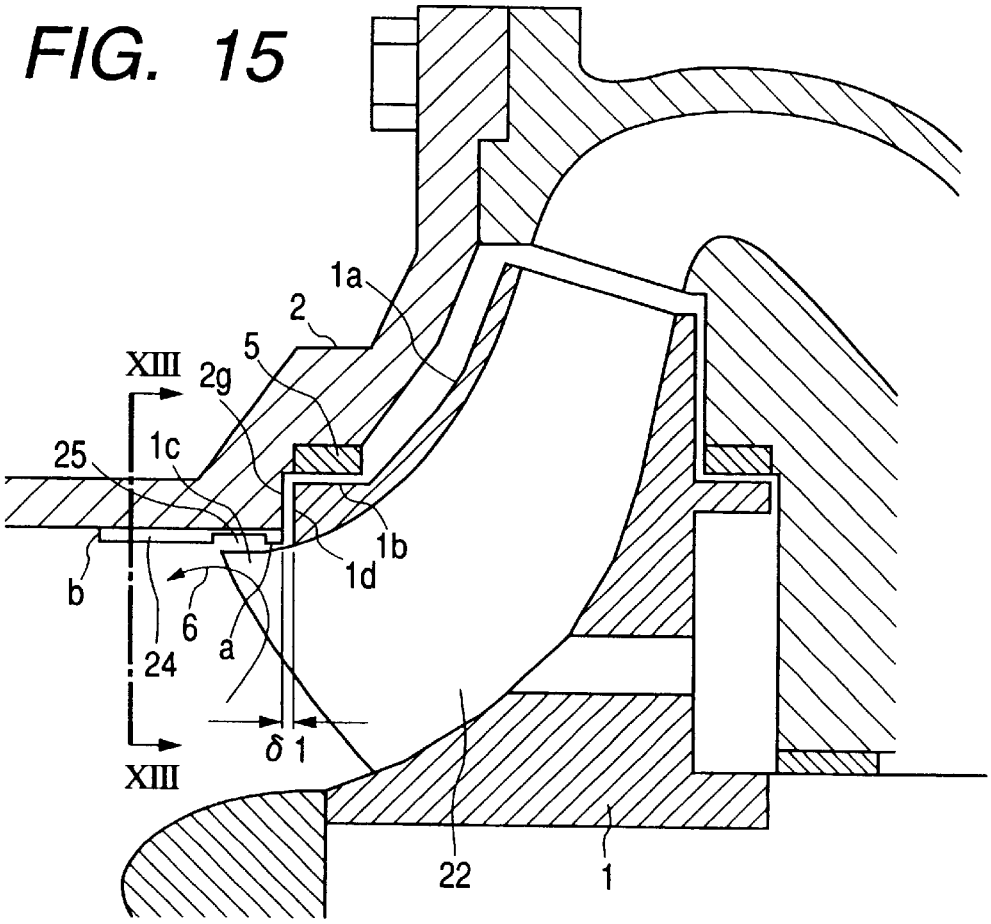
FIG. 15 is a meridian plane view of a principle portion of an embodiment, wherein the first embodiment according to the present invention shown in the FIG. 1 is applied into a turbo machine using a closed-type impeller having a shroud thereabouts.
Figure 16:
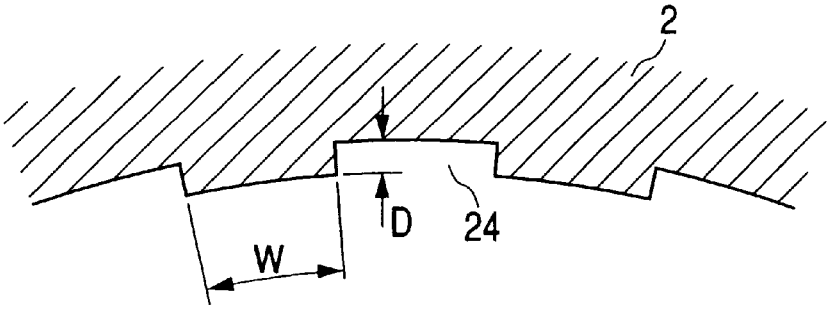
FIG. 16 is a cross-section view along with a XIII—XIII cutting line in the FIG. 15.
Figure 17A:
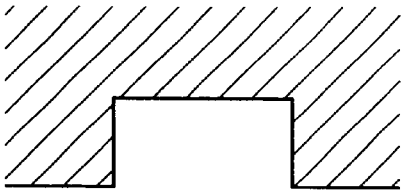
FIGS. 17(*a*) to (*d*) show various examples of cross-section shapes of grooves formed on the inner flow surface of the casing.
Figure 17B:
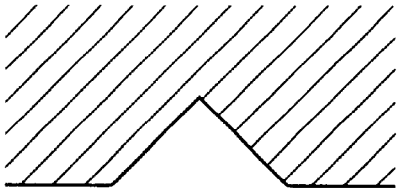
Figure 17C:
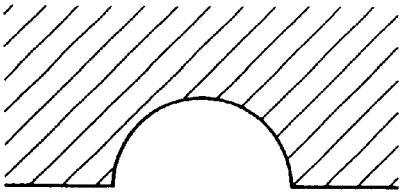
Figure 17D:
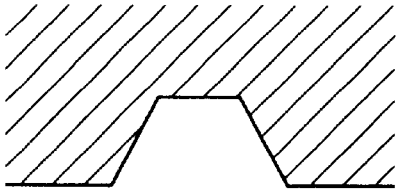

FIG. 15 shows an example, wherein the first embodiment according to the present invention is applied into a turbo machine (for example, a mixed-flow pump of closed-type) which uses a closed-type impeller having a shroud as a part thereof. FIG. 16 shows a cross-section view along with a XIII—XIII line in the FIG. 15.

In the closed-type impeller 1, there is provided a shroud 1*a*. However, this shroud la is not provided in the vicinity 1*c* of the inlet of the impeller blades, but the impeller is in a form of so-called an impeller of semi-open type, having a portion where no shroud is provided thereon. In the most inner diametric portion of the shroud, there is provided a-mouse ring portion 1*b*, and on the inner flow surface of the casing 2 at the stationary side opposing to this is provided a casing ring 5. Between those mouse ring portion 1*b* and the casing ring 5 is constructed a sealing portion of an rotating axis. On the inner circumference of the inner flow surface of the casing 2, opposing to the impeller blades having no such the shroud around it, in the vicinity 1*c* of the inlet of the impeller blades, as are shown in the FIGS. 15 and 16, a plurality of the first grooves 24 in the axial direction are aligned around the circumference of the casing at an equal distance therebetween. A terminal position a of the grooves at the down-stream side of the turbo machine lies from the front edge of the impeller blades until a position entering into the down-stream side a little bit (i.e., the position neighboring or adjacent the mouse ring portion 1*b*, in the vicinity of the inlet of the impeller blades), while a terminal position b at the upper-stream side of the turbo machine is located in the side being upper than the front edge of the blades of the impeller. A portion 2*g* of the casing 2 opposing to the end surface 1*d* of the shroud of the impeller is constructed so as to be at a position being almost same to the terminal position a of the grooves 24 at the down-stream side in the axial direction, and to be upon a surface in a direction being orthogonal to the axis thereof. This surface (i.e., the portion) 2*g* and the end surface 1*d* of the shroud are opposing to each other at a distance δ1 in the axial direction. A reference numeral 25 indicates the second groove formed in the circumferential direction, in the vicinity of the area of the first grooves 24 in the axial direction where the impeller blades reside in, and this groove 25 communicates with the first grooves which are formed over the inner circumference of the casing, and is formed as the groove being shallower than the first grooves.

When the turbo machine (i.e., the pump) is operated in a region of low flow rate, the recirculation (i.e., reverse flow) will occur as shown in the FIG. 15. With such the structure mentioned above, according to the present embodiment, a portion of the fluid compressed by the impeller flows back from the terminal position a at the down-stream side up to the terminal position b at the upper-stream side within the first grooves. Since the grooves 24 are formed into a direction of the axis of the pump, the fluid flowing inside the grooves has no component in a direction of rotation of the impeller, and is spouted into the position where the recirculation occurs when the flow rate is low, thereby weakening or distinguishing the recirculation, and as the result of this, the generation of recirculation can be suppressed. Accordingly, it is possible to prevent from or suppress the generations of a swirl or pre-whirl which is caused at the inlet side of the impeller due to the recirculation, as well as the stall of rotation of the impeller blades, then the decrease of a theoretical head comes to be small, thereby improving the characteristic of uprising at the right-hand side of the head-flow rate characteristic curve in the turbo machine.

Also, the fluctuation in pressure due to the interference which is caused when the blades 22 pass by the grooves 24 in the axial direction can be reduced or mitigated by the existence of the second grooves 25, and the pressure difference between the grooves 24 can be also reduced or mitigated thereby, therefore it is possible to suppress a phenomenon that, the turbo machine is vibrated by the fluctuation in pressure, thereby to be increased in the vibration and noises.

Although the explanation was given on the closed-type mixed-flow pump in the embodiments mentioned above, the present invention also can be applied to other turbo machines, such as a centrifugal pump, a mixed-flow air blower, a mixed-flow compressor, etc., each having the open-type impeller or the closed-type impeller.

Also, the shape or form in the cross-section of the grooves 24 in axial direction (i.e., the pressure gradient direction of fluid) formed on the inner flow surface of the casing may be made a triangle, a round, or a trapezoidal one, as shown in the FIGS. 17(*a*) to (*d*), other than a rectangular. The grooves 25 and 33 may also be made in the same shape as in the cross-section thereof.

An operating flow rate by the pump of the pump station is determined at a point intersecting between a static head which is determined as a difference between the water heads or levels at the suction side and the discharge side in the pump station, a resistance curve which is determined by summing up resistance in the flow passage or pipes in the pump station, and the head-capacity characteristic curve of the pump. If there is a region uprising at the right-hand side in the head-capacity characteristic curve, there can be a case where the head-capacity characteristic curve intersects with the resistance curve at a plurality points. In such the instance, it is impossible to determine the crossing point at only one point, i.e., the flow rate cannot be determined uniquely, therefore the flow rate cannot be determined. In particular, it is remarkable when the stationary head is high and the pipe resistance is small.

In the conventional art, by bringing the maximum efficiency and the stability of the head into a balance so as to obtain the head-capacity characteristic curve without the behavior of uprising at the right-hand side, therefore there may be a tendency that the maximum efficiency is decreased down a little bit. Also, in a case where there is the unstable region in the pump, the operation region of the pump must be in a region where no such the unstable operation occurs, thereby making the operation region narrow. Therefore, in a case where the operation enters into the unstable region for one unit of the pumps, such a measure must be taken that the pumps are increased up in the number thereof with making the capacity for each of the pumps small, so as to shift the operation point of the each pump into a point outside 27 the unstable region. Applying the present invention mentioned in the above, it is possible to dissolve such the problems of those conventional arts. Further, according to the present invention, with the provision of the grooves on the periphery thereof, it is possible to reduce the generation of the fluctuation in pressure due to the interference between the grooves in the axial direction and the flow from the impeller, thereby to reduce the vibration and noises in the main body of the pump, as well as in the conduits thereof, being caused by the vibration of the pump with the fluctuation in pressure. Accordingly, with the present invention, there can be obtain an effect that the turbo machines having high performances without such the characteristic of uprising at the right-hand side, and that the turbo machine obtained can also be applied even into the pump station, etc., neighboring a residential place.

The present invention can achieve a great effect when it is applied to the mixed-flow pump, and it can achieve a remarkable effect, in particular when being applied into the pump having a specific speed Ns as an index of indicating the characteristic of the pump, indicated in the following:

$$Ns=N\times Q^{0.5}/H^{0.75}\approx 1{,}000 \text{ to } 1{,}500$$

when assuming that a rotational speed is N (rpm), a total head is H (m), and a discharge flow rate Q ($m^3$/min).

And a great effect can be obtained, in particular when being applied into a pump, wherein a static head determined by a suction water level and a discharge water level is equal or greater than 50% of the head at a specific point.

According to the present invention, with the provision of the plurality of first grooves for communicating between the inlet side of the impeller and the area on the inner flow surface of the casing where the impeller resides in, and of the plurality of second grooves for communicating those plural first grooves in the circumferential direction thereof, there can be obtained a turbo machine, having a head-flow rate characteristic being improved, in particular in the characteristic uprising at the right-hand side, and enabling to suppress the decrease in the efficiency thereof, as well as the increase in the vibration and noises therein.

Further, with the provision of the plural grooves in the pressure gradient direction of fluid, and the movable members being provided in movable within a radial direction thereof so as to change the depth of the grooves, it is also possible to achieve the same or similar effect as mentioned in the above.

Further, according to the present invention, by applying the structure of the semi-open type, in which no shroud is formed in the vicinity of the inlet of the impeller, into a turbo machine having an impeller of closed type having the shroud therewith, there also can be obtain a turbo machine having the same or similar effect as mentioned in the above.

What is claimed is:

1. A turbo machine comprising:

a casing;

an impeller having a plurality of blades and being positioned within said casing;

a plurality of first grooves being formed on an inner flow surface of said casing for conducting between an inlet side of said impeller and an area of the inner flow surface of said casing where the blades of said impeller reside in; and a second groove being formed on the inner flow surface of said casing for connecting said plurality of first grooves in a circumferential direction of said casing.

2. A turbo machine as defined in the claim 1, wherein said plurality of first grooves are formed to be equal or greater than 5 mm in width, so that a total width of said plurality of the first grooves comes to be about 30%–50% with respect to a length of an inner circumference of the inner flow surface of said casing where the blades of said impeller reside in, and to be equal or greater than 2 mm in depth, so that it comes to be about 0.5% 1.6% with respect to a diameter of the inner flow surface of said casing where the blades of said impeller reside in.

3. A turbo machine as defined in the claim 1, wherein said second groove is formed on the inner flow surface of said casing where the blades of said impeller reside in.

4. A turbo machine as defined in the claim 1, wherein said second grooves are formed to be equal or shallower than said first grooves in depth thereof.

5. A turbo machine as defined in the claim 1, wherein said second groove is formed to be deeper than said first grooves in depth thereof.

6. A turbo machine as defined in the claim 1, wherein said second grooves are formed in a plurality number thereof, directing in the circumferential direction of said casing, intermittently.

7. A turbo machine as defined in the claim 1, wherein said second groove is formed from a front edge position or in a vicinity of the blades of said impeller, on the inner flow surface of said casing, up to the area where the blades of said impeller reside in, or up to terminal ends of the first grooves.

8. A turbo machine as defined in the claim 1, wherein said second groove is formed from terminal ends of said first grooves at a down-stream side of said turbo machine, on the inner flow surface of said casing, up to the area where the blades of said impeller reside in, or up to the inlet side of said impeller.

9. A turbo machine as defined in the claim 1, wherein said second groove is formed in a spiral shape thereof, on the inner surface of said casing, from the inlet side of said impeller up to a terminating position of said first grooves at a down-stream side of said turbo machine.

10. A turbo machine comprising:

a casing;

an impeller having a plurality of blades and being positioned within said casing; and a plurality of grooves in a direction of pressure gradient of fluid, being formed on an inner flow surface of said casing, for communicating between an inlet side of said impeller and an area of the inner flow surface of said casing where the blades of said impeller reside in, wherein said grooves are formed in the direction of gradient in pressure of fluid so that they are inclined into a direction of rotation of said impeller, toward from a vicinity of an inlet portion of the impeller to a down-stream side of said turbo machine.

11. A turbo machine comprising:

a casing;

an impeller having a plurality of blades and being positioned within said casing;

a plurality of first grooves in a direction of gradient in pressure of fluid, being formed on an inner flow surface of said casing at an inlet side of said impeller, over an inner circumference thereof;

a second groove being formed on the inner surface of said casing, within an area where the blades of said impeller reside in, directing in a circumferential direction thereof; and a flow passage for connecting between said first grooves and said second groove.

12. A turbo machine as defined in the claim 11, wherein said flow passage comprises at least one of those including a groove, a bore, a conduit and a tube, being formed bypassing the inner surface of said casing.

13. A turbo machine comprising:

a casing;

an impeller having a plurality of blades and being positioned within said casing;

a plurality of first grooves in a direction of gradient in pressure of fluid, being formed on an inner surface of said casing at an inlet side of said impeller, over an inner circumference thereof;

a second groove being formed on the inner surface of said casing within an area where the blades of said impeller reside in, directing in a circumferential direction thereof; and a third groove being formed on the inner surface of said casing in a vicinity of a front edge of the blades of said impeller, directing in the circumferential direction thereof; and a flow passage for connecting between said second groove and said third groove, wherein said flow passage is formed on a line extending from said first groove, bypassing the inner surface of said casing, so as to be communicated with said first groove through said third groove.

14. A turbo machine comprising:

a casing;

an impeller having a plurality of blades and being positioned within said casing;

a plurality of grooves in a direction of gradient in pressure of fluid, being formed on an inner flow surface of said casing over an inner circumference thereof, for communicating between an inlet side of said impeller and an area of the inner flow surface of said casing where the blades of said impeller reside in; and movable members provided within said grooves in the direction of gradient in pressure of fluid, being movable in a radial direction of said casing so as to change depth of said grooves.

15. A turbo machine as defined in the claim 14, wherein said movable members are so positioned that the depth of said grooves becomes large in an operation region of said turbo machine where a characteristic curve between a head pressure and a flow rate of said turbo machine rises up at right-hand side, while said movable members are so positioned that the depth of said grooves becomes small or zero in an operation region where the characteristic curve does shows no such the rises up at right-hand side.

16. A turbo machine comprising:

a closed-type impeller having a plurality of blades and a shroud thereabouts;

a casing having an inner flow wall and receiving said impeller therein, wherein said impeller is formed into an open-type having no shroud thereabouts in vicinity of an inlet of said impeller; and a plurality of first grooves in a direction of gradient in pressure, being formed on an inner flow wall of said casing, opposing to a portion of said impeller having no shroud thereabouts in vicinity of the inlet thereof, over an inner circumference thereof, wherein a starting end of said first grooves at an inlet side is positioned at an upper flow side than a tip inlet side of said impeller, while a terminal end of said first grooves is positioned at a lower flow side than the tip inlet side of said impeller; and further comprising:

a second groove for connecting said plurality of the first grooves in the circumferential direction of said casing, being formed on the inner flow wall of said casing, opposing to the portion of said impeller having no shroud thereabouts in vicinity of the inlet thereof.

17. A turbo machine comprising:

an impeller;

a casing receiving said impeller therein;

a plurality of first grooves in a direction of gradient in pressure of fluid, being formed on an inner flow surface of said casing, opposing to an outer peripheral portion of blades of said impeller at an inlet side thereof, for connecting between an area where recirculation occurs at the inlet side of said impeller when flow rate is low and an area on the inner flow surface of said casing where tips of the blades of said impeller reside in, wherein terminals of said first grooves at a downstream side of the turbo machine are positioned so that fluid of pressure can be taken out for suppressing a generation of the recirculation within a main flow, in inlets of said first grooves at an upper-stream side of the turbo machine; and a second groove being formed on the inner flow surface of said casing in a vicinity of the inlet of said impeller, for connecting said plurality of first grooves in a circumferential direction thereof, wherein portions of said casing where said first and second grooves are provided are formed as a body being separated from other portion of said casing.

* * * * *